US005248398A

United States Patent [19]

Cordani

[11] Patent Number: 5,248,398

[45] Date of Patent: * Sep. 28, 1993

[54] PROCESS FOR DIRECT ELECTROLYTIC REGENERATION OF CHLORIDE-BASED AMMONIACAL COPPER ETCHANT BATH

[75] Inventor: John L. Cordani, Waterbury, Conn.

[73] Assignee: MacDermid, Incorporated, Waterbury, Conn.

[ * ] Notice: The portion of the term of this patent subsequent to Feb. 4, 2009 has been disclaimed.

[21] Appl. No.: 614,929

[22] Filed: Nov. 16, 1990

[51] Int. Cl.[5] ..... C25C 1/12

[52] U.S. Cl. ..... 204/106; 204/107; 204/108; 204/130; 156/642; 156/656; 156/666; 134/10; 134/13

[58] Field of Search ..... 204/105 R, 106, 107, 204/108, 130; 252/79.4; 134/10, 13; 156/642, 656, 666

[56] References Cited

U.S. PATENT DOCUMENTS

| | | | |
|---|---|---|---|
| 4,146,438 | 3/1979 | de Nora et al. | 204/106 |
| 4,490,224 | 12/1984 | Warheit | 204/130 |
| 4,564,428 | 1/1986 | Furst | 204/107 |
| 4,772,365 | 9/1988 | Haas | 204/106 |
| 4,784,785 | 11/1988 | Cordani et al. | 252/79.4 |
| 4,915,776 | 11/1990 | Lee | 156/642 |
| 4,957,611 | 9/1990 | Collini | 204/106 |
| 5,085,730 | 2/1992 | Cordani | 204/106 |

*Primary Examiner*—John Niebling
*Assistant Examiner*—David G. Ryser
*Attorney, Agent, or Firm*—St. Onge Steward Johnston & Reens

[57] ABSTRACT

A novel bipolar cell is described together with a method for employing the same in the electrowinning of heavy metals (copper, nickel, cobalt and the like) from baths such as etchants, electroless plating baths and the like. In a particular application, the bipolar cell is used to regenerate a chloride-based ammoniacal copper etching bath by electrowinning a portion of the copper therein. The regeneration is accomplished without generating any significant amount of gaseous chlorine. The regeneration of the copper etching bath in this manner is used in a closed loop system for maintaining at a substantially constant level the amount of copper present in an operating ammoniacal chloride copper etchant bath.

10 Claims, 2 Drawing Sheets

PROCESS FOR DIRECT ELECTROLYTIC REGENERATION OF CHLORIDE-BASED AMMONIACAL COPPER ETCHANT BATH

FIELD OF THE INVENTION

This invention relates to a novel electrolytic cell and a process for its use in the electrowinning of heavy metals from baths containing such metals and is inclusive of a process for the direct regeneration of chloride-based ammoniacal copper etchant baths.

BACKGROUND OF THE INVENTION

Baths containing heavy metals such as copper, nickel, cobalt and the like in soluble form are widely used commercially in plating, etching and other processes. The disposal of waste from such baths in an environmentally safe manner presents a challenge. The first step of many disposal processes generally involves electrolytic deposition of at least a major portion of the heavy metal content, followed by treatment of the remaining bath liquid to remove other constituents. The removal of heavy metals from waste baths by electrolytic deposition in this manner is referred to hereinafter as electrowinning of the metal.

The treatment of etchant baths containing copper forms a special instance of such an electrowinning process since, in many cases, such baths can be regenerated for further use as etchants by electrowinning of a portion of the copper content therefrom. The etching of copper is a step carried out in a variety of production processes. A particular example is found int he manufacture of circuit boards which generally begins with a non-conducting substrate such as a phenolic or glass reinforced epoxy sheet laminated on one or both sides with a layer of copper foil. An etch resist image in the shape of a desired circuit pattern is applied to the copper foil and the foil so imaged is subjected to the action of an etchant, by spraying or immersion, to remove the copper not covered by the etch resist. The resist-covered copper circuit pattern is thereby caused to stand out in vertical relief.

The etchants most widely used commercially are cupric chloride alkaline ammoniacal solutions because they provide high etch rates. A major drawback of this type of etchant lies int he difficulty of treating and disposing of the waste therefrom. Electrolytic attempts to recycle or regenerate such baths directly have hitherto been largely unsuccessful due to the corrosive nature of the etchant and the large amounts of chlorine gas which are generated.

Efforts have been made to employ cupric sulfate alkaline ammoniacal etchants since these can be regenerated by electrolytic means without generating chlorine gas. However, these sulfate-based baths suffer from low etch rates. Cordani et al U.S. Pat. No. 4,784,785 reviews prior attempts to increase the etch rate of these baths and describes the use of organic thio compounds to accelerate the etch rate. However, the accelerated rate so achieved is still significantly less than that of chloride-based etchants.

Attempts to regenerate chloride-based etchants using processes which do not generate chlorine gas are reviewed in Lee U.S. Pat. No. 4,915,776, the teachings of which are incorporated herein by reference. These various attempts include electrolytic recovery of the copper content by indirect techniques. The '776 patent is also directed to a process of treating spent etchant. The process involves precipitating copper as a copper hydroxide sludge by reaction with calcium hydroxide. The ammonia gas which is also generated in the reaction is then reacted with the aqueous calcium chloride solution (remaining after the precipitation) and carbon dioxide gas to generate an aqueous solution of ammonium hydroxide and ammonium chloride and a precipitate of calcium carbonate. After separation of the latter, the remaining solution is used to formulate a fresh etchant bath. This process requires high initial investment in complex equipment, as well as further treatment to recover metallic copper from the hydroxide precipitate.

Furst et al U.S. Pat. No. 4,564,428 describes a process for regenerating a sulfate-based ammoniacal copper etchant bath by electrolytic means in the presence of a small amount of ammonium chloride. The oxygen generated at the anode is said to prevent evolution of chlorine gas.

It has now been found that heavy metals can be recovered from baths containing the same by electrowinning using a novel bipolar cell having significantly improved efficiency as will be described in detail hereafter. It has been found further that the novel cell in question has the additional advantage in that it can be used to regenerate chloride-based ammoniacal copper etchant baths by direct electrolytic means without generating of any significant amount of chlorine gas. The copper is recovered from the etchant bath in the form of ductile sheets which can be stripped from the cathode.

SUMMARY OF THE INVENTION

It is the object of the invention to provide a novel electrolytic cell for the electrowinning of heavy metals from baths containing the same. It is a further object of the invention to provide an improved process for the electrowinning of heavy metals from waste baths containing the same. It is still another object of the invention to regenerate chloride-based ammoniacal copper etchant baths by direct electrolytic means without generating of chlorine gas. It is a further object of the invention to recover copper in ductile sheet form from chloride-based ammoniacal copper etchant baths. It is yet another object of the invention to provide a closed loop system for maintaining a chloride-based ammoniacal copper etchant bath in operating condition for a prolonged period of time by continuously removing liquid from said bath, subjecting the liquid so removed to direct electrolytic regeneration and returning regenerated bath liquid to the main bath on a continuous basis.

These objects, and other objects which will become apparent from the description which follows, are achieved by the apparatus and process of this invention. The latter in one aspect thereof comprises a bipolar cell which comprises, in combination, (a) a tank adapted to hold a liquid electrolyte and having disposed therein a cathode comprising a sheet of an etch resistant metal, an anode which can be carbon or a sheet of an etch resistant metal optionally coated with a layer of a conductive noble metal oxide; (b) at least one bipolar plate fabricated from tantalum or an etch resistant metal coated on one side thereof with a layer of a conductive metal oxide, suspended in said tank but not connected electrically to the anode or cathode; and (c) a source of direct electric current adapted to be connected across the anode and cathode.

The invention includes a process for electrowinning heavy metals from liquid baths containing the same using the bipolar cell of the invention.

In a particular aspect, the invention also comprises a process for the direct electrolytic regeneration of a chloride-based ammoniacal copper etchant bath substantially without generating gaseous chlorine by electrowinning a portion of the copper from the bath using the bipolar cell of the invention. Copper is deposited on the cathode and the cathode side of the at least one bipolar plate in the form of a peelable, ductile sheet. In a related aspect, the invention also comprises a closed loop system for maintaining a chloride-based ammoniacal copper etchant bath in operable condition by constantly removing liquid from the bath, on a continuous or semi-continuous basis, subjecting the withdrawn liquid to electrolytic regeneration using the above process, and returning regenerated liquid to the etchant bath to maintain the latter at constant volume and cupric ion content.

DETAILED DESCRIPTION OF THE INVENTION

Typical baths containing heavy metals include baths for the electrolytic or electroless deposition of copper, nickel and nickel/cobalt alloys, and etchant baths for etching of copper and like heavy metals. When such baths have reached or approached the end of their useful life, it is necessary to dispose of the contents thereof in an environmentally acceptable manner or, in certain cases, particularly in the case of etchant baths, to regenerate the same by reducing the heavy metal content thereof. The removal of all, or a significant portion, of the heavy metal content of such baths by electrowinning is a commonly used step in the waste disposal process and/or int he regeneration process. The use of the novel bipolar cell of the present invention enables the electrowinning to be carried out in a manner which is characterized by greater efficiency in both energy required and reduction of operating time necessary to accomplish the desired result.

Figure 1:
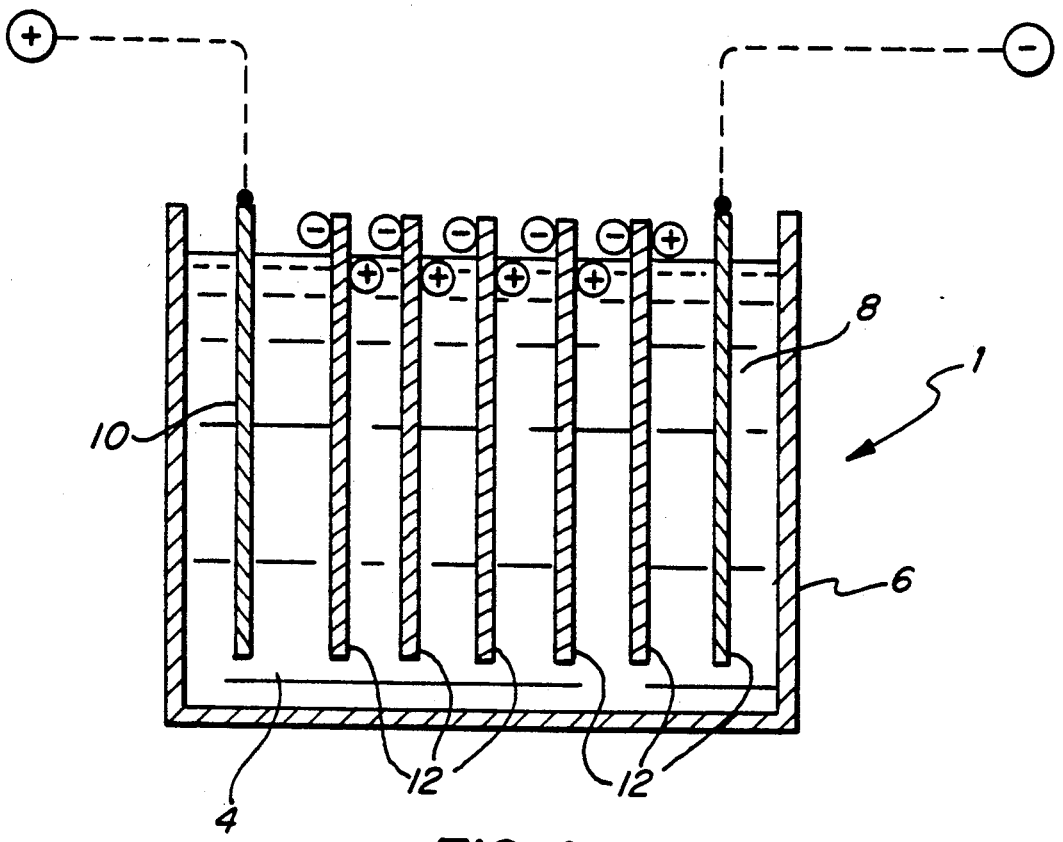
FIG. 1 shows in schematic form a typical bipolar cell in accordance with the invention.
Figure 1A:
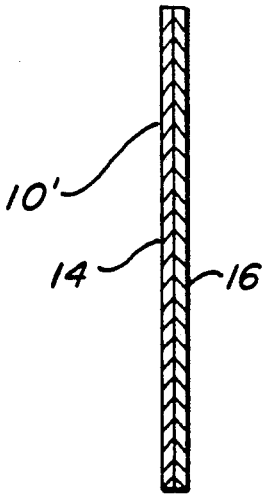
FIG. 1A shows in cross-section an alternative form of anode for use in a cell in accordance with the invention.

FIG. 1 shows in schematic form a typical bipolar cell arrangement, shown overall as (1), in accordance with the invention. The liquid bath (4) which is to be subjected to electrowinning is held in tank (6) which is provided with anode (10) and cathode (8). Cathode (8) is fabricated, advantageously but not necessarily, in sheet form, from an etchant resistant metal such as platinum, palladium, titanium, tantalum, niobium and the like. Anode (10) is fabricated in rod, sheet or other structural forms conventionally employed in the art, from carbon or an etch resistant metal which can be the same or different from that used in cathode (8). Anode (10) can also take the form, illustrated as (10') in cross-section in FIG. 1A, of a sheet of an etch resistant metal (14) on one side of which is a layer (16) of conductive oxide of a noble metal. The term "noble metal" is inclusive of iridium, ruthenium, gold, platinum, palladium and the like. In an alternative form of (10') the layer of conductive oxide is present on both sides of metal sheet (14). Anode (10) and cathode (8) are suspended in tank (6) by conventional means (not shown), for example, by strap means dependent from bus bars through which direct current can be supplied to the cell from an appropriate source.

Figure 1B:
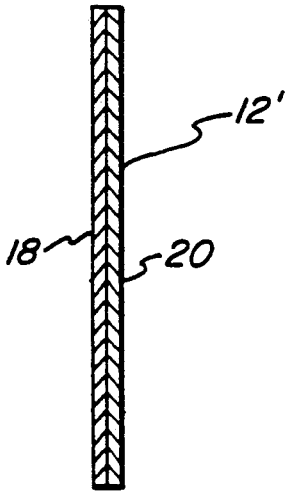
FIG. 1B shows in cross-section a particular form of a component of a cell in accordance with the invention.

Also suspended in tank (6) are bipolar plates (12) which are fabricated from tantalum metal alone or, in an alternative embodiment shown as (12') in cross-section in FIG. 1B, from a sheet (18) tantalum or other etch resistant metal (as exemplified above) on one side only of which is a layer (20) of a conductive oxide of noble metal as exemplified above. When the alternative form (12') of bipolar plate is employed, the plate is disposed in tank (6) so that layer (20) is on the side closest to cathode (8). The bipolar plates employed in any given cell in accordance with the invention can all be of form (12) or form (12') or a mixture of the two types in any proportion can be employed. The bipolar plates (12) or (12') are suspended in tank (6) by conventional means (not shown) such as straps depending from bus bars and the like. However, the bipolar plates are not connected electrically to each other or to either cathode (8) or anode (10) or to any external source of electric current.

When a voltage is applied across the cell (1) a positive charge is induced on each of the sides of bipolar plates (12) which are oriented towards cathode (8) and a negative charge is induced on each of the sides oriented towards the anode (10) as shown in FIG. 1. In the case of the use of coated bipolar plates (12') when oriented as described above, the positive charge is induced on the coated side and the negative charge is induced on the exposed metal side. Thus in electrowinning of heavy metals from baths containing the same, the deposition of metal occurs not only on cathode (8) but on the negatively charged sides of bipolar plates (12) or (12'). Hence the rate at which deposition, i.e., electrowinning, of metal takes place is significantly enhanced compared with the rate achieved using electrolytic cells hitherto employed in the art. Further, the increase in rate is achieved without increasing significantly the current density applied to the cell. Accordingly, the use of the cell leads to a significant increase in efficiency of operation not only in terms of shorter operation time.

While the number of bipolar plates (12) shown in FIG. 1 is five, it is to be understood that this number is chosen for purposes of illustration only. In actual practice there can be as few as one and as many as can be accommodated depending upon the size of cell (6) which is employed in any given instance. The actual number employed is not critical and the appropriate number to employ in any given instance is readily determined by a process of trial and error.

In a particular application, the cell and process of the invention are employed in the direct electrolytic regeneration of chloride-based ammoniacal copper etchant baths. Such baths generally comprise aqueous solutions containing, as the main components, a cupric ammonium chloride complex and ammonium hydroxide. As the etching process proceeds, the cupric ammonium chloride gradually increases in concentration. When the cupric ion concentration reaches a certain level, generally of the order of about 150 g./liter, the rate at which further etching will take place becomes significantly reduced. When this point is reached it is necessary either to prepare a fresh etchant bath and disposed of the previous one or, preferably, to restore the etch rate of the bath to its former level. In order to achieve the latter result it is necessary to regenerate the bath by reducing the copper content below the above level, and advantageously to a level below about 100 g./liter, without significantly altering the nature and/or concentrations of the other components of the bath. This desirable result is achieved by the process of the invention.

Thus, the copper etchant bath to be regenerated is subjected to direct electrolysis in a cell according to the invention as discussed in reference to FIG. 1 above. The temperature of the bath is advantageously maintained in the range of about 70° F. to about 170° F. and preferably in the range of about 70° F. to about 90° F. The pH of the bath liquid is advantageously in the range of about 7.8 to about 9.5 and preferably in the range of about 8.0 to about 8.2. The current density employed is advantageously in the range of about 10 to about 300 amp/sq.ft. (ASF) and preferably in the range of about 70 to about 150 ASF. As the electrolysis proceeds copper is deposited in sheet form on the cathode (8) and on the cathode side of each of the bipolar plates (12). The electrolysis is continued until the level of copper in the bath liquor has fallen to a desired level generally of the order of about 60 g./liter. At this time the etchant liquid remaining in the cell is ready for re-use. The copper sheet deposited on the cathode (8) and cathode side of plates (12) can be removed readily by peeling in the form of a ductile sheet. The bath remaining in the cell can then be re-employed as an etchant bath or used to recharge another operating bath.

Figure 2:
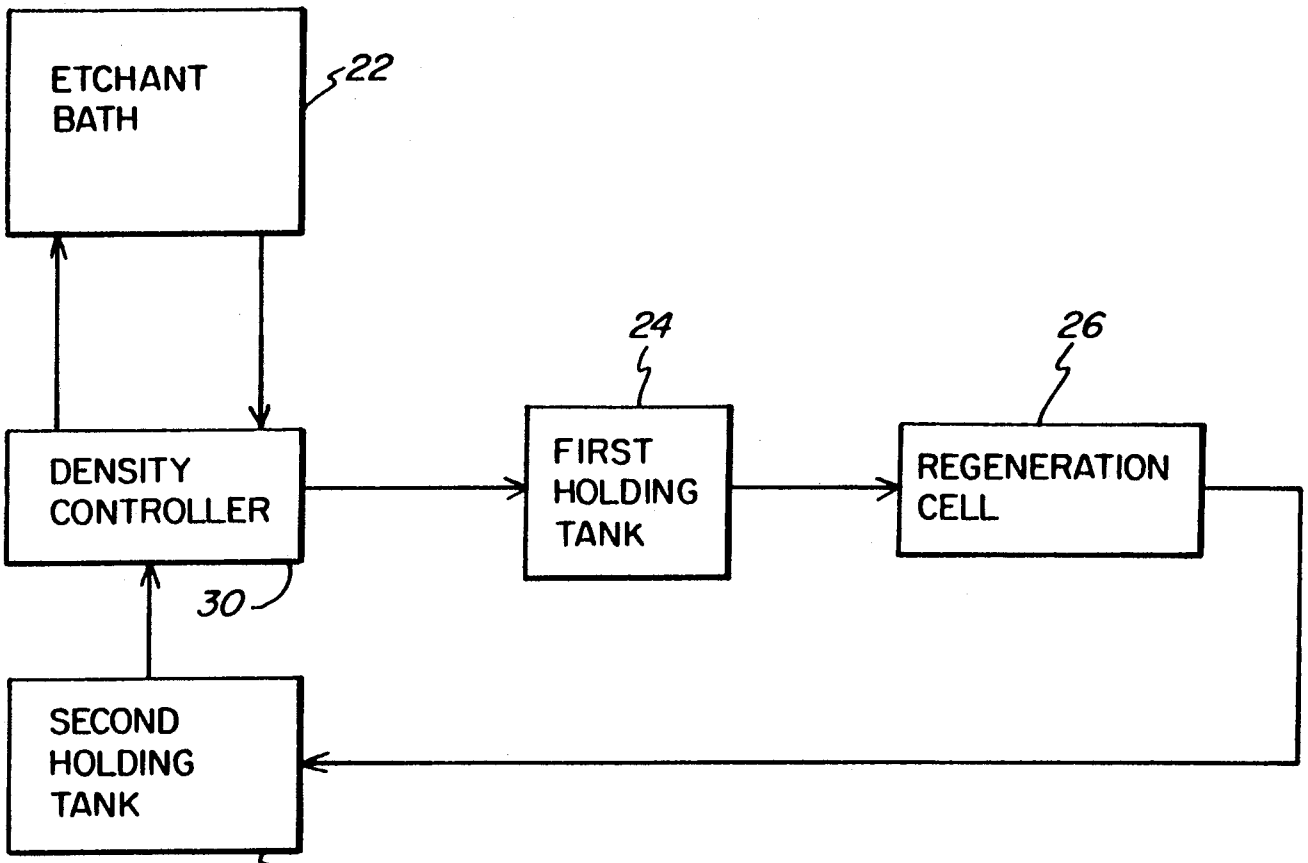
FIG. 2 shows in schematic form a closed loop system employing a process in accordance with the invention.

The above-described process for the direct electrolytic regeneration of a chloride-based ammoniacal copper etchant bath can be incorporated into a closed loop system for maintaining at a substantially constant level the amount of copper present in an operating etchant bath of the above type. FIG. 2 shows such a closed loop system in schematic form. In the system shown, liquid is withdrawn from operating etchant bath (22), on a continuous or semi-continuous basis, and transferred to a first holding tank (24). The liquid in tank (24) is regenerated in cell (26) in increments corresponding to the capacity of the cell. Cell (26) is operated in accordance with the invention as described above in regard to the embodiment shown in FIG. 1. The electrolysis of each increment is continued until the copper concentration in the liquid has fallen to a predetermined level, typically of the order of about one-half of the copper concentration in bath (22). When this point is reached the regenerated etchant is transferred to second holding tank (28) where it is stored with increments already processed. Regenerated etchant is transferred on a continuous or semi-continuous basis, as required, to the operating etchant bath (22). The amount of regenerated fluid returned to bath (22) at a given time is equal to the amount withdrawn for regeneration at the same time.

Density controller (30) constantly monitors the density of etchant bath (22). The bath density is directly related to the cupric ion concentration. When a change in bath density indicates that the cupric ion concentration has increased to a predetermined level, controller (30) generates signals which activate the appropriate pump means which cause a portion of bath (22) to be transferred to first holding tank (24) and an equal portion of regenerated bath liquor to be transferred from second holding tank (28) to bath (22). The cupric ion content of bath (22) is thereby reduced to a predetermined level and operation of the etchant bath continues until controller (30) again detects the incremental rise in density and again activates the above described cycle. The employment of density controller (30) in this manner is well-known in the art and, accordingly, further discussion of the nature of the electronic components, circuitry, and calibration of the equipment involved therein is omitted. Illustrative of density controllers which are available commercially is the DSX-2 Density Controller marketed by MacDermid Inc. of Waterbury, Conn.

The following is a typical example of a direct electrolytic regeneration process according to the invention. Four liters of a typical working bath of chloride-based ammoniacal copper etchant was processed in an electrolytic cell having titanium cathode, a titanium sheet coated on one side with a layer of iridium oxide [Eltec Inc.] as anode, and having suspended in the etchant two bipolar plates identical to the anode but not connected electrically thereto or to the cathode. The etchant initially contained 120 g./liter of copper, 170 g./liter of chloride ion and 180 g./liter of ammonium hydroxide. The pH was 8.3. A current density of 100 ASF was applied with the etchant liquor at 26.7° C. The electrolysis was continued until a total of about 240 g. of copper had been deposited on the cathode and on the cathode side of the cathode/anode plates. No chlorine gas was generated during the electrolysis. A total of 309 ampere hours was required. The copper was recovered in the form of ductile sheets which were readily peeled from the cathode and the anode/cathode plates. The copper sheets so obtained were found to have a purity of 98.9 percent. The liquor so regenerated was used to replenish an operating etchant bath. The addition of the regenerated liquor did not affect the etch rate of the bath which remained at $2.5 \pm 0.1$ mil/minute.

The direct electrolytic regeneration of chloride-based ammoniacal copper etchants in accordance with the invention has a significant number of advantages. The bipolar cell arrangement is compact, economical and efficient. Substantially no toxic chlorine gas is generated at the anode, in direct contrast to attempts previously made to regenerate chloride-based ammoniacal copper etchants. Further, no waste products which require disposal are generated since both the copper sheet recovered in the process and the regenerated etchant can be recycled. Other systems employed to recover copper from etchant baths by electrolysis have general deposited the copper in the form of a powder which is much more difficult to separate and handle. As discussed above, the process of the invention has the further advantage that it can be incorporated in a closed loop etchant system which enables an operating etchant bath to be maintained at a constant etch rate over prolonged periods. Further, the process of the invention can be carried out using pH values in the etchant at the low level of about 7.8 to 8.6. This allows the etchant to be used in etching inner layers which utilize organic etch resists sensitive to higher pH.

It is to be understood that the various embodiments of the invention which have been shown and discussed above, have been described for illustration only and are not to be construed as limiting. Various modifications which can be made to the process and system without departing from the scope of the invention will be readily apparent to one skilled in the art.

What is claimed is:

1. A process for the direct electrolytic regeneration of a chloride-based ammoniacal copper etchant bath substantially without generating gaseous chlorine, which process comprises subjecting said bath to electrolysis employing an etch resistant metal cathode and an anode selected from the group consisting of carbon, tantalum, and an etch resistant metal coated with a layer of a conductive noble metal oxide, and wherein said bath also has suspended therein at least one bipolar plate selected from tantalum and a sheet of etch resistant metal coated on one side thereof with a layer of a conductive metal oxide, said at least one bipolar plate being not connected electrically to said anode or cathode.

2. A process according to claim 1 wherein there is a plurality of said bipolar plates suspended in said bath.

3. A process according to claim 2 wherein said bipolar plates are disposed symmetrically in said bath and, for plates comprised on an etch resistant metal coated on one side with a layer of conductive metal oxide, with the coated sides thereof facing towards said cathode.

4. A process according to claim 1 wherein said cathode is fabricated from titanium.

5. A process according to claim 1 wherein said at least one bipolar plate is a sheet of titanium having one side thereof coated with a layer of an oxide of iridium, ruthenium, platinum, palladium or gold.

6. A process according to claim 1 wherein said electrolytic regeneration is continued until the concentration of copper in said etchant bath has been decreased to a concentration below about 100 g/l.

7. A process according to claim 6 wherein deposited copper is thereafter removed from said cathode and from the cathode side of said at least one bipolar plate in the form of a ductile sheet.

8. In a process for maintaining the copper content of a chloride-based ammoniacal copper etchant bath at a substantially constant concentration during continuous operation of said bath, the steps comprising:

(a) periodically withdrawing a portion of said bath;

(b) subjecting said portion so withdrawn to electrolytic regeneration in accordance with the process of claim 8 for a time effective to substantially reduce the copper concentration in said portion; and (c) thereafter returning to said bath the said portion, or a similar portion previously withdrawn and regenerated.

9. A process according to claim 8 wherein the withdrawal of etchant from said bath and the return to said bath of regenerated etchant is carried out on a continuous basis.

10. A process according to claim 9 wherein the etchant continuously withdrawn from said bath is transferred to a first storage means, portions are fed from said first storage means to the vessel in which the electrolytic regeneration is carried out, and the etchant so regenerated is fed to second storage means from which is it continuously withdrawn and returned to said bath at a rate corresponding to that at which etchant is being withdrawn from said bath to said first storage means.

* * * * *